US007335829B2

(12) United States Patent
Yoshisue et al.

(10) Patent No.: US 7,335,829 B2
(45) Date of Patent: Feb. 26, 2008

(54) BAT FOR UPRIGHT PIANO

(75) Inventors: Kenji Yoshisue, Hamamatsu (JP); Kiyoshi Abe, Hamamatsu (JP)

(73) Assignee: Kabushiki Kaisha Kawai Gakki Seisakusho, Shizuoka-Ken (JP)

( * ) Notice: Subject to any disclaimer, the term of this patent is extended or adjusted under 35 U.S.C. 154(b) by 0 days.

(21) Appl. No.: 11/529,154

(22) Filed: Sep. 28, 2006

(65) Prior Publication Data

US 2007/0068361 A1 Mar. 29, 2007

(30) Foreign Application Priority Data

Sep. 29, 2005 (JP) ..... 2005-285174

(51) Int. Cl.
*G10C 3/18* (2006.01)

(52) U.S. Cl. ..... 84/238

(58) Field of Classification Search ..... 84/236–238, 84/173, 174

See application file for complete search history.

(56) References Cited

U.S. PATENT DOCUMENTS 5,353,671 A * 10/1994 Inoue et al. ..... 84/236

2006/0201308 A1* 9/2006 Tanaka ..... 84/236

FOREIGN PATENT DOCUMENTS

JP 06-027934 2/1994

* cited by examiner

*Primary Examiner*—Kimberly Lockett
(74) *Attorney, Agent, or Firm*—Crowell & Moring LLP

(57) ABSTRACT

A bat for an upright piano is provided for ensuring stable swinging movements of a hammer to generate a proper piano sound even if a hammer assembly has the centroid which is laterally asymmetric about a center pin. The bat for an upright piano is supported by the center pin having a circular cross section and arranged horizontally in a bat flange, in order to swing a hammer to cause the same to strike a string. The bat comprises a bat body integrally formed with the hammer, and having a linear pin holding groove in a back surface thereof, and a metal plate having a linear pin retaining groove in one side thereof, and attached to a back surface of the bat body such that the pin retaining groove extends in parallel with the pin holding groove, wherein the bat is pivotally supported by the center pin while the center pin is in engagement with the pin holding groove and the pin retaining groove, and the center pin is sandwiched between the bat body and the metal plate.

6 Claims, 5 Drawing Sheets

FIG. 6

| | EXAMPLE | COMPARATIVE EXAMPLE |
|---|---|---|
| ROCKWELL HARDNESS | 128.3 | 100 |

BAT FOR UPRIGHT PIANO

BACKGROUND OF THE INVENTION

1. Field of the Invention

The present invention relates to a bat for an upright piano, which is supported by a center pin disposed on a bat flange, and strikes a string by swinging a hammer in response to a key touch.

2. Description of the Prior Art

A conventional bat for an upright piano is disclosed, for example, in Laid-open Japanese Patent Application No. 6-27934. This bat, which has a general structure, is provided on a key-by-key basis, in association with a hammer having a hammer head at an upper end thereof, a catcher and the like (hereinafter, the bat, hammer, and catcher are collectively called the "hammer assembly"). The bat has its lower end pivotally supported by a center pin of a bat flange.

The bat flange has bat supports which protrude upward from a left and a right end, respectively, and a center pins extend horizontally between the left and right bat supports. One known bat has a bat body to which a bat plate is attached. In such a bat, the bat body is made, for example, of an ABS resin, and has a lower end which has a width smaller than the remaining part. A groove having a V-shaped cross section is formed in the back surface of the lower end, and laterally extends. The bat plate is attached with the groove in engagement with the center pin which is sandwiched between the bat plate and bat body. In this state, the bat is in engagement with the center pin at a total of three points, i.e., two points on a wall surface above and below the groove of the bat body, and one point on the front surface of the bat plate. In this way, the hammer assembly including the bat is pivotally supported by the center pin, and pivotally moves about the center pin in response to a key touch which causes the jack of an action to push up the lower surface of the bat body. Then, the hammer strikes a string at the back thereof, and vibrates the same, thereby generating a piano sound.

However, the conventional bat described above implies the following problems. In an upright piano, due to the structure of the action, frame and the like, the hammer can be mounted on the bat laterally asymmetrically about the fulcrum of pivotal movements of the bat particularly in a bass area. In this arrangement, the hammer assembly is installed with its centroid laterally shifted with respect to the fulcrum. This results in a moment, during a pivotal movement, which causes the hammer to laterally hobble about the vicinity of the center pin, as indicated by an arrow M1 or an arrow M2 in FIG. 1. As such, loads intensively act on the left and right ends of the center pin, respectively, in the opposite directions to each other from both ends of the groove of the bat body. Thus, as indicated by an arrow m1 or an arrow m2 in FIG. 1, excessive loads act on the both ends of the groove as counter-forces from the center pin, so that the center pin relatively moves outward of the groove along the wall surface of the groove. Consequently, the hammer assembly laterally hobbles and therefore cannot swing with stability. Also, such hobbling can result in deformation of the groove, and a gap between the center pin and groove. In this event, the hammer assembly becomes wobbly, possibly resulting in a failure in stable pivotal movements of the hammer assembly, the inability of the hammer head to strike a string at a proper striking position, and a failure in generating a proper piano sound.

Another conventional bat for an upright piano is formed with a groove in its lower end, which has a semi-circular cross section. A center pin, in contact with an entire wall surface of the groove, is sandwiched between a bat plate and a bat body. In this structure, even when a hammer assembly has the centroid which laterally offsets, a counter-force from the center pin can be supported by the entire wall surface of the groove in a well balanced manner, thus making it possible to prevent deformation of the groove.

However, if the center pin varies in diameter, a gap is developed between the groove and center pin when the diameter is smaller, whereas the center pin cannot be brought into engagement with the groove when the diameter is larger. Therefore, even such variations in diameter that can be generally assumed, can cause rather unfavorable situations in view of the stability.

SUMMARY OF THE INVENTION

The present invention has been made to solve the problems as mentioned above, and it is therefore an object of the invention to provide a bat for an upright piano which is capable of ensuring stable swing movements of a hammer to generate a proper piano sound even if a hammer assembly has the centroid which is laterally asymmetric about a center pin.

To achieve the above object, the present invention provides a bat for an upright piano, which is supported by a center pin having a circular cross section and arranged horizontally in a bat flange, in order to swing a hammer to cause the same to strike a string in response to a key touch. The bat is characterized by comprising a bat body integrally formed with the hammer, and having a linear pin holding groove in a back surface thereof, and a metal plate having a linear pin retaining groove in one side thereof, and attached to a back surface of the bat body such that the pin retaining groove extends in parallel with the pin holding groove, wherein the bat is pivotally supported by the center pin while the pin holding groove and the pin retaining groove are in engagement with the center pin, and the center pin is sandwiched between the bat body and the metal plate.

This bat for an upright piano is supported by the center pin of the bat flange, and has the bat body and metal plate attached to the bat body. The bat body is formed with a pin holding groove linearly extending in a back surface thereof, while the metal plate has a pin retaining groove which extends in opposition to the pin holding groove. The center pin is sandwiched between the bat body and metal plate in engagement with both the pin holding groove and pin retaining groove as described above, whereby the bat is pivotably supported by the center pin. When a key is touched, the bat pivotally moves about the center pin to associatively swing the hammer to strike a string, thereby generating a piano sound.

As described above, the center pin for supporting the bat is sandwiched between the bat body and the metal plate attached thereto, and is not only in engagement with the pin holding groove of the bat body, but also in engagement with the pin retaining groove formed in the metal plate. Therefore, even if the bad body tends to shift from the center pin in the vertical direction, possibly induced by swinging movements of the hammer, the center pin comes into contact with the wall surface of the pin retaining groove with which the center pin is in engagement, so that the pad body is prevented from moving. Consequently, the bat can be made less susceptible to the shifting with respect to the center pin, thereby allowing the center bat to stably support the bat and hammer.

Particularly, when the hammer swings with its centroid being placed in a laterally asymmetric relationship to the center pin (such swinging of the hammer is called "eccentric swinging"), loads intensively act on both ends of the center pin, so that even if the center pin tends to relatively move outward of the pin holding groove, the pin retaining groove can prevent the center pin from moving. In this way, as a result of preventing the center pin from moving, the pin holding groove and pin retaining groove can be restrained from deformations, and the bat and hammer can be restrained from wobbling. From the foregoing, it is possible to ensure that the hammer swings with stability, and to allow the hammer to appropriately strike a string.

Preferably, in the bat for an upright piano described above, each of the pin holding groove and the pin retaining groove includes a pair of inclinations which incline such that a spacing therebetween is smaller toward the bottom, and with which the center pin comes into engagement.

According to this preferred embodiment of the bat for an upright piano, each of the pin holding groove of the bat body and the pin retaining groove of the metal plate has a pair of inclinations. Each of these pairs of inclinations inclines such that their spacing is narrower toward the bottom of the groove, and the center pin is in engagement with the respective inclinations of these pairs. In other words, the center pin is in engagement with the bat body and metal plate at four circumferential points without play, and can thereby support the bat and hammer with higher stability.

Also, when the hammer eccentrically swings, the center pin tends to relatively move outward along one inclination of the pin holding groove. In the present invention, since one of the inclinations of the pin retaining groove in the metal plate is arranged to oppose one of the inclinations of the pin holding groove, the center pin can be retained by this one inclination to effectively block the relative movement. Consequently, the hammer can be more stably swung. Also, the spacing between the pair of inclinations of each groove is narrower toward the bottom, the center pin can be brought into engagement with each of the inclinations of both grooves without fail even if the center pin varies in diameter, thereby more reliably providing the aforementioned effects.

Preferably, in the bat for an upright piano described above, the pin holding groove includes a pair of stopper surfaces arranged on a back side of the bat body so as to be continuous to the pair of inclinations, respectively, wherein the pair of stopper surfaces are spaced from each other by a spacing which is narrower toward the bottom of the pin holding groove, and each stopper surface inclines at an angle larger than the inclinations and close to a right angle to the back surface of the bat body.

According to this preferred embodiment of the bat for an upright piano, as the hammer eccentrically swings to cause the center pin to relatively move outward of the pin holding groove along the inclination as mentioned above, the center pin tends to move outward along the stopper surface with a force smaller than a force with which it tends to move outward along the inclination because the stopper surfaces incline at an angle closer to a right angle than the inclinations, to the back surface of the bat body. As a result, the center pin can be more effectively prevented from relatively moving to further stably swing the hammer. Also, since a load acting from the center pin to the wall surface of the pin holding groove is distributed over the inclinations and stopper surfaces, the pin holding groove can be more effectively restrained from deformations to further restrain the bat and hammer from wobbling.

Preferably, in the bat for an upright piano described above, the bat body comprises a molding molded by a continuous fiber method and made of a thermoplastic resin containing long fibers for reinforcement.

According to this preferred embodiment of the bat for an upright piano, the bat body comprises a molding molded by a continuous fiber method and made of a thermoplastic resin containing long fibers for reinforcement. Here, the continuous fiber method involves injection molding of a pellet containing fibrous reinforcing materials of the same length covered with a thermoplastic resin to produce moldings. According to the continuous fiber method, relatively long fibrous reinforcing materials having a length of 0.5 mm, for example, are contained in the moldings. Thus, the bat of the present invention contains the relatively long fibers for reinforcement and can accordingly exhibit a very high rigidity, as compared with a bat made of a synthetic resin. Accordingly, even if the hammer eccentrically swings, the shape of the bat body can be held to ensure more stable swinging. Further, since the bat body is made of a thermoplastic resin, it is possible to achieve the advantage of the synthetic resin, i.e., high processing accuracy and dimensional stability.

Preferably, in the bat for an upright piano described above, the long fibers are carbon fibers.

According to this preferred embodiment of the bat for an upright piano, since carbon fibers are used for long fibers, the bad body can be improved in hardness than a bat body made, for example, of an ABS resin. Consequently, even if the hammer eccentrically swings, it is possible to further restrain the pin holding groove from deformations due to a counter-force from the center pin to further restrain the bat and hammer from wobbling.

Dust sticking to movable parts of the bat can cause their slow motions which can degrade the responsibility of the hammer. Also, in general, the carbon fiber is more electrically conductive than other long fibers for reinforcement, for example, glass fiber. Thus, by containing such carbon fibers in the thermoplastic resin, by which the bat body is made, as long fibers for reinforcement, the bat body can be improved in conductivity to reduce its electrostatic property. Consequently, since the reduced electrostatic property restrains dust from stacking to the bat body, the bat and hammer can provide consistently good movements and responsibility. Also, the dust restrained from sticking to the bat body can keep the appearance of the bat clear and prevent the operator's hands and clothing from being soiled in operations for adjusting the bat and the like.

Preferably, in the bat for an upright piano described above, the thermoplastic resin is an ABS resin.

The ABS resin has a high adhesivity among other thermoplastic resins. Therefore, when the bat body is made of the ABS resin, parts of the hammer can be readily adhered to the bat with an adhesive, thus facilitating the assembly of the bat.

Generally, when a thermoplastic resin containing a reinforcing material such as carbon fiber is injection molded at a high melt flow rate, the thermoplastic resin flows into a mold at higher speeds, causing a higher susceptibility to anisotropy in rigidity of the molding due to the reinforcing material tending to align in a particular direction in the molding. Also, the ABS resin is a thermoplastic resin containing a rubber-like polymer, and can be molded at a low melt flow rate. Accordingly, when the bat body is made of the ABS resin as described above, the bat body can be restrained in anisotropy and consistently provide a high rigidity. Further, the ductility exhibited by the ABS resin can enhance the impact strength of the bat.

BRIEF DESCRIPTION OF THE DRAWINGS

FIG. 6 is table showing the result of a hardness test for a material used for the bat body of the embodiment, together with a comparative example.

DETAILED DESCRIPTION OF THE PREFERRED EMBODIMENTS

In the following, a preferred embodiment of the present invention will be described in detail with reference to the accompanying drawings.

Figure 1:
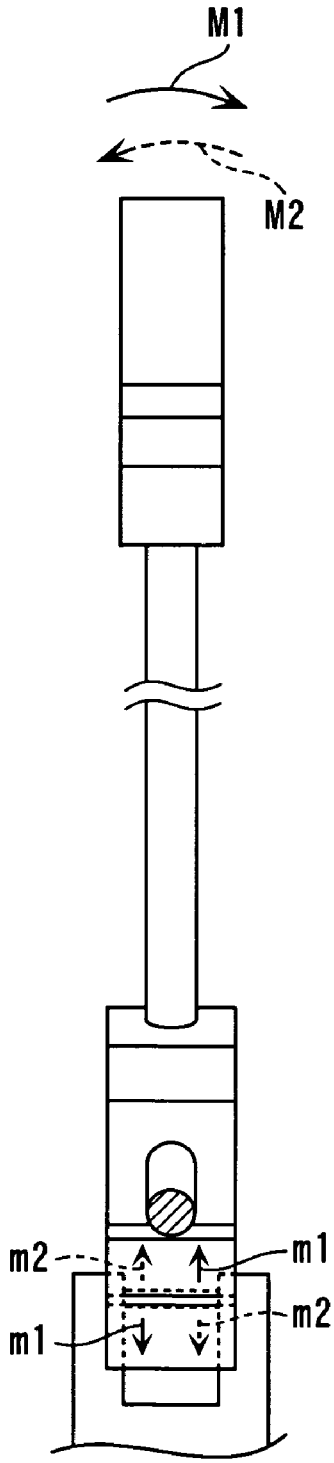
FIG. 1 is a front view of a conventional hammer assembly showing directions M1 and M2 in which a hammer hobbles when it eccentrically swings, and directions m1 and m2 in which corresponding counter-forces from a center pin act on a groove of a bat.
Figure 2:
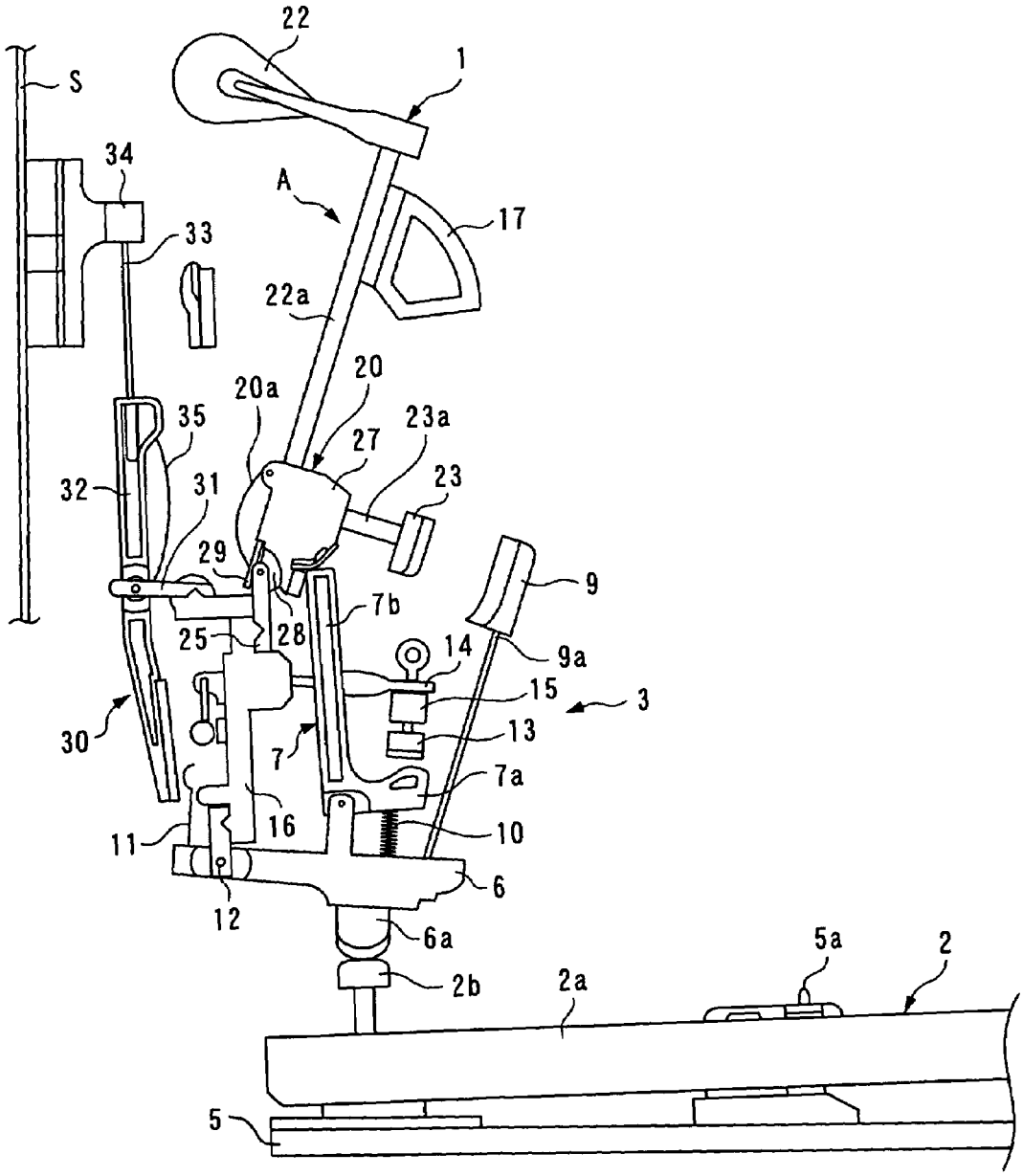
FIG. 2 is a side view illustrating an action, a key, a hammer and the like of an upright piano, to which a bat according to the present invention is applied, in a key released state.

FIG. 2 illustrates an action 3, to which a bat 20 for an upright piano according to one embodiment of the present invention is applied, together with a hammer 1, a keyboard 2 and the like, in a key released state. In the following description, assume that, as viewed from a player side, the front side of the upright piano is called the "front," and the back side of the same, the "rear."

The keyboard 2 comprises a large number of keys 2*a* (only one of which is shown) arranged side by side from left to right (in a depth direction in FIG. 2), and each key 2*a* is swingably supported by a fulcrum which is a balance pin 5*a* implanted on a keybed 5.

The action 3 is attached to brackets (none of which is shown) arranged at a left and a right end of the keybed 5, respectively, above the rear end of the keyboard 2, and arranged to extend between both the brackets. The action 3 also comprises a wippen 6, a jack 7, the aforementioned bat 20, and the like which are provided for each key 2*a* (only one each of them is shown). Further, a center rail 16 and a hammer rail 17 are extended between the left and right brackets, and a wippen flange 12 and a bat flange 25 (only one each of them is shown) are fixed to the center rail 16 with screws for each key 2*a*. The wippen 6 is pivotably supported by the wippen flange 12 at a rear end portion thereof.

The wippen 6, which is formed, for example, of a synthetic resin such as an ABS resin or a wood material in a predetermined shape, has a heel 6*a* extending downward from the front, and is carried on a capstan button 2*b* arranged on the top surface of a corresponding key 2*a* in a rear end area through the heel 6*a*. A back check wire 9*a* is implanted on the top surface of the wippen 6 in a front end area, and a back check 9 is attached to a leading end thereof. A spoon 11 is also implanted on the wippen 6 in a rear end area for driving the damper 30. Also, the aforementioned wippen flange 12 is disposed immediately in front of the spoon 11.

The jack 7, which is made, for example, of a synthetic resin or a wood material, is molded in an L-shape. The jack 7 comprises a base 7*a* extending in a front-to-back direction; and a hammer push-up rod 7*b* extending upward from the rear end of the base 7*a*. The jack 7 is pivotably supported at the corner between the base 7*a* and the hammer push-up rod 7*b* at a position behind the back check wire 9*a* of the wippen 6. A jack spring 10 is also provided between the base 7*a* and wippen 6.

A regulating button 13 is arranged above the base 7*a* of the jack 7. The regulating button 13 is provided for each key 2*a* through a plurality of regulating brackets 14 (only one of which is shown) disposed on the center rail 16, and a regulating rail 15 which is attached to the front end of the regulating bracket 14 and extends from left to right.

A bat flange 25 fixed to the center rail 16 with screws is made, for example, of a synthetic resin in a block shape, and hammer supports 25*a* (only one of which is shown) protrude upward from a left and right end, respectively. A center pin 26 having a circular cross section is provided between these hammer supports 25*a* to extend horizontally in the lateral direction.

Figure 3:
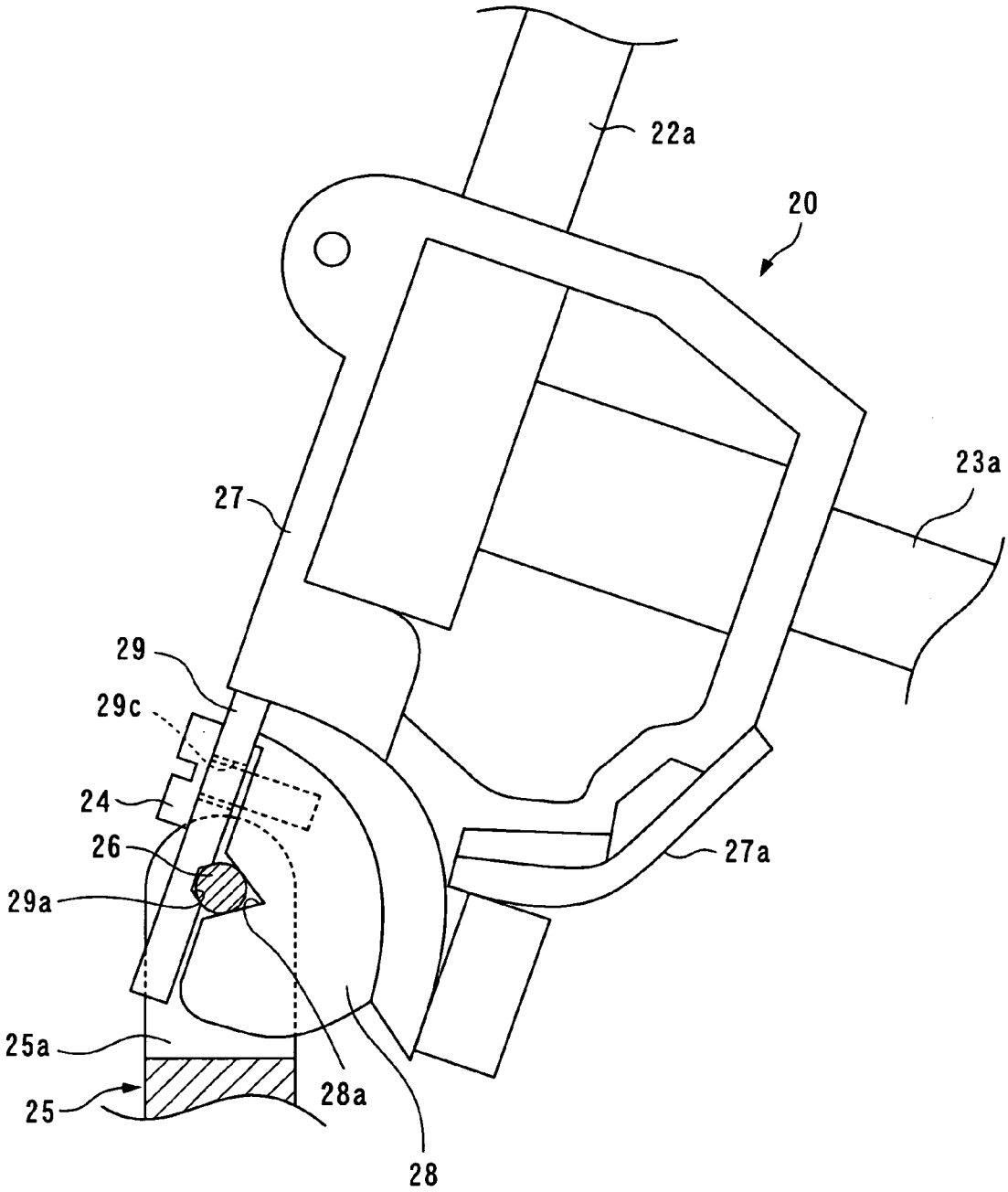
FIG. 3 is a partially enlarged side view illustrating a bat flange, and the bat supported by a center pin of the bat flange in FIG. 2.
Figure 4:
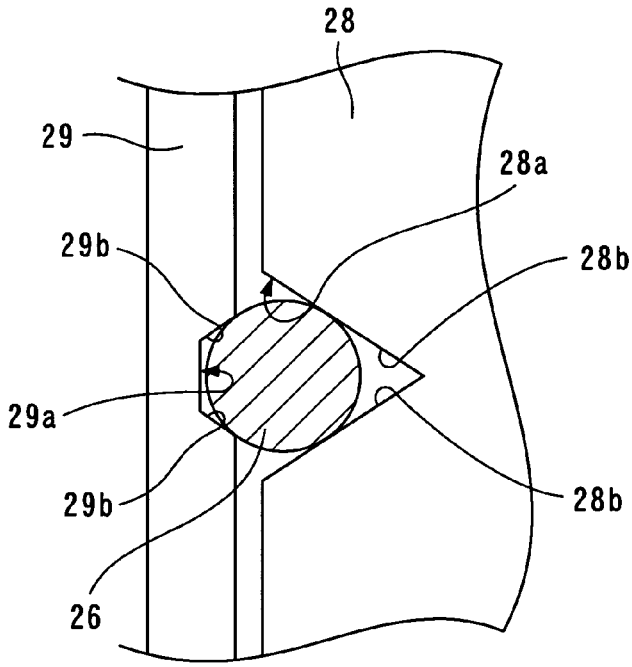
FIG. 4 is a partially enlarged side view illustrating a pin holding groove of a bat body, and a pin retaining groove of a metal plate in FIG. 3, together with the center pin which is in engagement with these parts.

The bat 20 is supported by the bat flange 25, and is integrally provided with a hammer 1 and catcher 23 (hereinafter, the bat 20, hammer 1, and catcher 23 are collectively called the "hammer assembly A"). As illustrated in FIGS. 2 and 3, the bat 20 has a bat body 27, and a metal plate 29 attached to a back surface of the bat body 27. The bat body 27 basically has the same shape and size as conventional bat bodies. Also, the bat body 27 is formed by a continuous fiber method, is injection molded using a pellet as described below. This pellet is manufactured by covering lobings made of carbon fiber with a thermoplastic resin containing a rubber-like polymer, for example, an ABS resin, which is one type of synthetic resin, extruded by an extruder, while the lobings are made even with a predetermined tension applied thereto. In this way, the lobings of carbon fiber can be contained in the pellet when it is molded without bending the lobings, so that the pellet contains carbon fibers which are equal in length to the pellet. In this embodiment, the length of the pellet is set in a range of 5 to 15 mm, whereby carbon fibers of 0.5 to 2 mm long are contained in the damper lever 32 which is injection molded using the pellet. A melt flow rate is set to a relatively small value for the aforementioned rubber-like polymer, for example, in a range of 0.1 to 50 g per 10 minutes under a testing condition including the temperature of 230° C. and a load of 2.12 kg.

The bat body 27 also has a pin mount 28 which is formed with a pin holding groove 28*a* on a back surface thereof for attaching the bat 20 to the center pin 26 of the bat flange 25. The pin holding groove 28*a* horizontally extends in a linear fashion in the back surface in the lateral direction. The pin holding groove 28*a* is formed in a V-shape in cross section by a pair of an upper and a lower wall surface 28*b*, the spacing of which is narrower toward the bottom of the pin holding groove 28*a*. The wall surfaces 28*b* are inclined at a predetermined angle with respect to the back surface of the pin mount 28.

A screw hole 29*c* is formed through an upper region of the metal plate 29, such that the metal plate 29 is removably attached to the back surface of the pin mount 28 by a screw 24 which is inserted through the screw hole 29*c* to cover the back surface. The metal plate 29 has substantially the same width as the pin mount 28, and has a predetermined thickness. A pin retaining groove 29*a* is laterally formed below the screw hole 29*c* in the front surface of the metal plate 29. The pin retaining groove 29*a* horizontally extends to oppose the pin holding groove 28*a* of the pin mount 28 from the back. Also, the pin retaining groove 29*a* is formed in a trapezoidal shape in cross section, and has a pair of an upper and a lower inclination 29*b*. The spacing between the inclinations 29*b* is narrower toward the bottom of the pin retaining groove 29*a*, and the inclinations 29*b* are inclined at a predetermined angle with respect to the front surface of the metal plate 29. Also, the upper inclination 28*b* of the pin holding groove 28*a* and the upper inclination 29*b* of the pin retaining groove 29*a* are in a substantially perpendicular relationship to each other. Likewise, the lower inclination 28*b* of the pin holding groove 28*a* and the lower inclination 29*b* of the pin retaining groove 29*a* are in a substantially perpendicular relationship to each other.

The metal plate 29 as described above is attached to the bat body 27 with a screw 24 with the center pin 26 of the bat flange 25 being sandwiched between the metal plate 29 and pin mount 28, and a slight gap being defined between the metal plate 29 and pin mount 28. Specifically, the front half of the center pin 26 is placed in the pin holding groove 28*a*, and is engaged with the inclinations 28*b* of the pin holding groove 28*a* at two circumferential points. Also, a rear end of the center pin 26 is placed in the pin retaining groove 29*a*, and is engaged with the inclinations 29*b* at two circumferential points. In the foregoing structure, the bat 20 is supported by the center pin 26 in engagement with the four circumferential points of the center pin 26 without play.

The hammer 1 comprises a hammer shank 22*a* implanted on the bat body 27 and extending in the vertical direction, and a hammer head 22 attached to the upper end of the hammer shank 22*a*. The hammer head 22 opposes a string S stretched vertically at the back thereof, such that the hammer head 22 strikes the string S at the lateral center thereof in association with a pivotal movement of the hammer 1.

The bat body 27 is also provided with a catcher shank 23*a* which extends in front diagonally downward from the front surface of the bat body 27, and a catcher 23 is attached to the front end of the catcher shank 23*a* in opposition to the back check 9 located in front. A bat spring 20*a* is provided between the bat body 27 and the bat flange 25 for urging the hammer assembly A including the bat 20 in the clockwise direction in FIG. 2. In a key released state, the hammer assembly A remains stationary with the hammer push-up rod 7*b* of the jack 7 in engagement with a pushed corner 27*a*, formed by a front end area of the bottom surface of the bat body 27, from below.

A damper 30 (only one of which is shown) is provided for each key 2*a* behind the action 3. The damper 30 comprises a damper lever 32 pivotably attached to a damper flange 31 screwed to the center rail 16, a damper wire 33 implanted on the damper lever 32, a damper head 34 attached to an upper end of the damper wire 33, a damper lever spring 35 for urging the damper lever 32 toward the string S, and the like. The damper 30 is provided to stop sound by the damper head 34 which is brought into contact with, and presses against the string S by an urging force of the damper lever spring 35 when the key 2*a* is released.

Next, a description will be given of a sequence of operations performed by the aforementioned action 3, hammer 1 and the like from the start to the end of a key depression. As a player touches the key 2*a* from the released state as illustrated in FIG. 2, the key 2*a* pivotally moves in the clockwise direction in FIG. 2 about the balance pin 5*a* to push up the wippen 6 carried in the rear end area thereof, thereby causing the same to pivotally move upward (counter-clockwise direction). Associated with the pivotal movement of the wippen 6, the jack 7, back check 9, and spoon 11 mounted on the wippen 6 move together, and the bat 20 is pushed up by the hammer push-up rod 7*b* of the jack 7. Consequently, the hammer assembly A swings toward the string S, positioned behind, in the counter-clockwise direction, while the respective inclinations 28*b*, 29*b* of the pin holding groove 28*a* of the bat body 27 and the pin retaining groove 29*a* of the metal plate 29 slide along the peripheral surface of the center pin 26.

When the wippen 6 has pivotally moved over a predetermined angular distance after the key touch was started, the spoon 11 disposed in a rear end area of the wippen 6 comes into contact with the lower end of the damper lever 32, and is pressed against the damper lever 32, causing the damper lever 32 to pivotally move in the clockwise direction against the urging force of the damper lever spring 35. This causes the damper head 34 to move away from the string S, thus allowing the string S to vibrate.

As the wippen 6 has further pivotally moved over a predetermined angular distance, the front end of the base 7*a* of the jack 7 comes into contact with the regulating button 13 from below. Consequently, the jack 7 is restricted from moving upward, and pivotally moves in the clockwise direction with respect to the wippen 6 against the urging force of the jack spring 10, causing the hammer push-up rod 7*b* to let off the bat 20 in front and come off the bat 20. Even after the jack 7 has come off the bat 20, the hammer assembly A continues to swing with inertia to strike the string S for vibrations, thereby generating sound. Then, the hammer assembly A starts a swinging movement in the clockwise direction by a repellent force of the string S. After the key touch has been completed with the key 2*a* being released, the key 2*a*, action 3 and the like pivotally move in the direction reverse to that when the key was touched, to return to the key released state illustrated in FIG. 2, thus completing a sequence of operations from the start to the end of the key touch.

During a swinging movement of the hammer assembly A associated with a key touch as described above, when the hammer assembly A suddenly changes in operation, particularly, when it is pushed up by the jack 7, when the hammer head 22 strikes the string S, and the like, a large load acts from the bat 20 to the center pin 26 which supports the bat 20. This load causes the bat 20 to move in the vertical direction relative to the center pin 26. In other words, when viewed from the center pin 26, the center pin 26 tends to move outward from the pin holding groove 28*a* along the inclination 28*b* of the pin holding groove 28*a*. In this event, one inclination 28*b* of the pin holding groove 28*a* and one inclination 29*b* of the pin retaining groove 29*a* are in a substantially perpendicular relationship, so that the inclination 29*b* extends at an angle close to a right angle with respect to a direction in which the center pin 26 moves. Accordingly, by retaining the center pin 26 with the inclination 29*b*, the center pin 26 can be effectively prevented from relative movements.

The foregoing description also applies when the hammer 1 eccentrically swings to cause a moment which causes the hammer head 22 to laterally wobble. Specifically, in this event, larger loads, in directions opposite to each other, intensively act on the left and right ends of the center pin 26 from the upper and lower inclinations 28*b* of the pin holding groove 28*a*. This causes the center pin 26 to move outward of the pin holding groove 28*a* at both ends thereof in the directions opposite to each other. In such an event, the pin retaining groove 29*a* of the metal plate 29 also retains both ends of the center pin 26 in the opposite direction to each other by its upper and lower inclinations 29*b*, thereby making it possible to effectively prevent the center pin 26 from moving.

As described above, the center pin 26 for supporting the bat 20, which is sandwiched between the bat body 27 and the metal plate 29 attached thereto, is not only in engagement with the pin holding groove 28*a* of the bat body 27, but also in engagement with the pin regaining groove 29*a* of the metal plate 29. Thus, even when the bat body 27 tends to shift vertically from the center pin 26 as the hammer 1 swings, the center pin 26 comes into contact with the inclination 29*b* of the pin retaining groove 29*a* in engagement therewith, thereby preventing the bat body 27 from moving. It is therefore possible to substantially prevent the bat 20 from shifting with respect to the center pin 26, and stably support the bat 20 and hammer 1 with the center pin 26.

Particularly, when the hammer 1 eccentrically swings, even if loads intensively act on both ends of the center pin 26 to cause the center pin 26 to relatively move outward of the pin holding groove 28*a*, the movement can also be prevented by the pin retaining groove 29*a*. In this way, as a result of preventing the center pin 26 from moving, it i is possible to restrain deformations of the pin holding groove 28*a* and pin retaining groove 29*a*, and to restrain wobbling of the bat 20 and hammer 1. From the foregoing, the hammer 1 can be ensured to stably swing, thus allowing the hammer 1 to properly strike the string.

Also, the pair of inclinations 28*b* of the pin holding groove 28*a*, and the pair of inclinations 29*b* of the pin retaining groove 29*a* are inclined such that the spacing therebetween is narrower toward the bottom of the groove, and the center pin 26 is in engagement with these pairs of inclinations 28*b*, 29*b*, respectively. Specifically, the center pin 26 is in engagement with the bat body 27 and metal plate 29 at four circumferential points without play, whereby the bat 20 and hammer 1 can be more stably supported by the center pin 26.

Also, in the present invention, one inclination 29*b* of the pin retaining groove 29*a* of the metal plate 29 is disposed to oppose one inclination 28*b* of the pin holding groove 28*a*, so that even if the center pin 26 tends to relatively move toward the outside along the one inclination of the pin holding groove 28*a* when the hammer 1 eccentrically swings, the one inclination 29*b* can retain the center pin 26, thus effectively preventing its relative movement. Consequently, the hammer 1 can be more stably swung. Also, since each pair of grooves 28*a*, 29*a* has the spacing which is narrower toward the bottom, the center pin 26 can be brought into engagement with each inclination 28*b*, 28*b* of the groves 28*a*, 29*a* without fail even if the center pin 26 varies in diameter, thereby more reliably providing the aforementioned effects.

Also, the bat body 27 comprises a molding made of thermoplastic resin containing long fibers for reinforcement, and exhibits a rigidity higher than the conventional bat body made of an ABS resin, so that even if the hammer 1 eccentrically swings, the shape of the bat body 27 can be held to ensure more stable swinging. Further, since the bat body 27 is made of a thermoplastic resin, it is possible to achieve the advantage of the synthetic resin, i.e., high processing accuracy and dimensional stability.

Also, since the bat body 27 is made of a thermoplastic resin which contains long carbon fibers for reinforcement, the bat lever 27 can be improved in conductivity to reduce the electrostatic property. Since the reduced electrostatic property restrains dust which could stick to the bat body 27, the hammer assembly A can provide consistently good movements and responsibility. Also, the dust restrained from sticking to the bat body 27 can keep the appearance of the bat body 27 clear and prevent the operator's hands and clothing from being soiled in operations for adjusting the hammer assembly A and the like.

The ABS resin has a high adhesivity among other thermoplastic resins, so that when the bat body 27 is made of the ABS resin, hammer shank 22*a*, catcher shank 23*a* and the like can be readily adhered to the bat body 27 with an adhesive, thus facilitating the assembly of the hammer assembly A.

Also, the ABS resin is a thermoplastic resin containing a rubber-like polymer and can be molded at a low melt flow rate. Accordingly, when the bat body 27 is made of the ABS resin, the bat body 27 can be restrained in anisotropy and consistently provide a high rigidity. Further, the ductility exhibited by the ABS resin can enhance the impact strength of the bat body 27.

FIG. 6 shows the result of a Rockwell hardness test which was made to confirm the hardness of the bat body 27 according to this embodiment, together with a comparative example. This test was made using a sample (labeled the "example") comprised of a molding made of an ABS resin which contains carbon fibers, which comprised the bat body 27 of this embodiment, and a sample (labeled the "comparative example") comprised of a molding made of an ABS resin, which comprised the conventional bat body as a comparative example. The result of the measurement shows that the example exhibits the Rockwell hardness of 128.3, where the comparative example is assumed to exhibit the Rockwell hardness of 100, thus confirming that the pin holding groove 28*a* of the bat body 27 of the embodiment is less susceptible to deformation than the conventional bat body.

Next, a description will be given of an exemplary modification to the bat 20 of the foregoing embodiment. This exemplary modification differs from the bat 20 of the foregoing embodiment only in the cross-sectional shape of the pin holding groove of the bat body 27.

Figure 5:
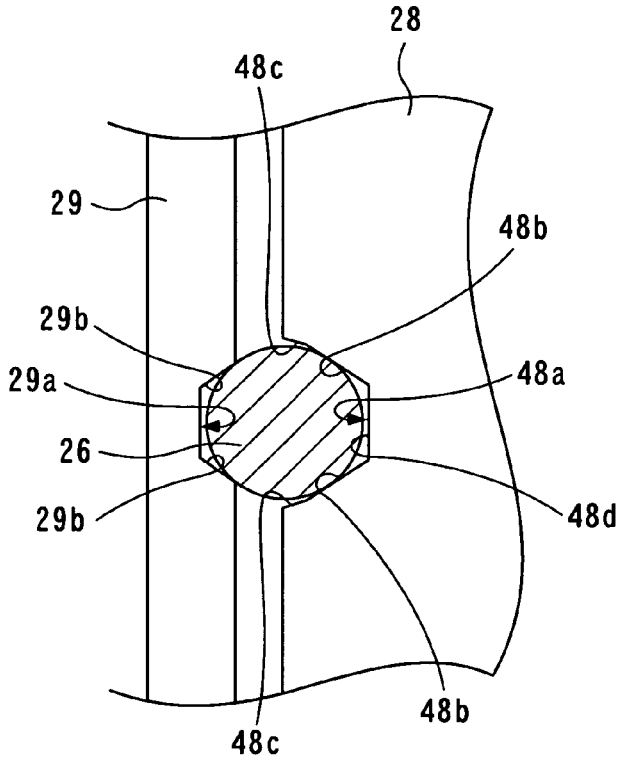
FIG. 5 is a partially enlarged side view illustrating a pin holding groove of a bat body, and a pin retaining groove of a metal plate, according to an exemplary modification of the present invention, together with the center pin which is engagement with these parts.

Specifically, the pin holding groove 28*a* in the foregoing embodiment has a V-shaped cross section with the upper and lower inclinations 28*b*, whereas as shown in FIG. 5, a pin holding groove 48*a* of the exemplary modification is formed in a hexagonal shape in cross section. Specifically, the pin holding groove 48*a* is defined by a bottom 48*d* extending in parallel with the back surface of the pin mount 28, a pair of inclinations 48*b* extending obliquely from an upper and a lower end of the bottom 48*d* toward the back surface of the pin mount 28, and a pair of stopper surfaces 48*c* continuous to the respective inclinations 48*b* on the back side of the pin mount 28. The inclination 48*b* inclines at the same angle to the back surface of the pin mount 28 as the inclination 28*b* of the foregoing embodiment, and the stopper surface 48*c* inclines at an angle, to the back surface of the pin mount 28, larger than that of the inclination 48*a* and close to a right angle.

The center pin 26 has its front half placed in the pin holding groove 48*a* and in engagement with the pair of inclinations 48*b*. The remaining parts of the bat 20 is similar in structure to that of the foregoing embodiment.

According to the foregoing structure, as the hammer assembly A swings or eccentrically swings, the center pin 26 relatively moves in the vertical direction along the inclination 48*b* in a manner similar to the foregoing embodiment. When viewed from the center pin 26, the center pin 26 comes into contact with the stopper surfaces 48*c* on the back side of the pin mount 28 when it moves outward of the pin holding groove 48*a* halfway along the inclination 48*b*. Since this pin stopper surfaces 48*c* incline at an angle, to the back surface of the bat body 27, larger than the inclination 48*b* and close to a right angle, the center pin 26 tends to move outward with a force smaller than a force with which it tends to move outward along the inclinations 48*b*. As a result, the center pin 26 is effectively prevented from relatively moving.

As described above, in the bat 20 of the exemplary modification, even if the center pin 26 tends to relatively move outward of the pin holding groove 48*a* along the inclinations 48*c*, the center pin 26 is prevented from moving by both of the stopper surfaces 48*c* and the inclinations 29*b* of the pin retaining groove 29 because the stopper surfaces 48*c* incline at an angle closer to a right angle than the inclinations 48*b* to the back surface of the pin mount 28. As a result, the center pin 26 is maintained in engagement with the inclinations 48*b* of the pin holding groove 48*a*, the stopper surfaces 48*c*, and the inclinations 29*b* of the pin retaining groove 29*a*. Consequently, the hammer assembly A can be swung with higher stability.

It should be understood that the present invention is not limited to the embodiments described above, but can be practiced in a variety of implementations. For example, in the exemplary modification described above, the center pin 26 supports the hammer assembly A while it is in contact with the bat body 27 and metal plate at four circumferential points, but the present invention is not limited to this manner of supporting the hammer assembly A. For example, the center pin 26, pin holding groove 48*a*, and pin retaining groove 29*a* may be more accurately formed such that the center pin 26 comes into engagement with one or both of the bottoms of the grooves in the bat body 27 and metal plate 29, in addition to the respective inclinations 48*b*, 29*b*. In this way, a counter-force from the center pin 26 can be more distributed in supporting the center pin 26, thus making it possible to further stably attach and swing the hammer assembly A. Otherwise, details in configuration can be modified as appropriate within the scope of the present invention.

What is claimed is:

1. A bat for an upright piano, supported by a center pin having a circular cross section and arranged horizontally in a bat flange, in order to swing a hammer to cause the same to strike a string in response to a key touch, said bat comprising:

a bat body integrally formed with said hammer, and having a linear pin holding groove in a back surface thereof; and a metal plate having a linear pin retaining groove in one side thereof, and attached to a back surface of said bat body such that said pin retaining groove extends in parallel with said pin holding groove, wherein said bat is pivotally supported by said center pin while said pin holding groove and said pin retaining groove are in engagement with said center pin, and said center pin is sandwiched between said bat body and said metal plate.

2. A bat for an upright piano according to claim 1, wherein each of said pin holding groove and said pin retaining groove includes a pair of inclinations which incline such that a spacing therebetween is smaller toward the bottom, and with which said center pin comes into engagement.

3. A bat for an upright piano according to claim 2, wherein:

said pin holding groove includes a pair of stopper surfaces arranged on a back side of said bat body so as to be continuous to said pair of inclinations, respectively, and said pair of stopper surfaces are spaced apart from each other by a spacing which is narrower toward the bottom of said pin holding groove, and each said stopper surface inclines at an angle larger than said inclinations and close to a right angle to the back surface of said bat body.

4. A bat for an upright piano according to claim 1, wherein said bat body comprises a molding molded by a continuous fiber method and made of a thermoplastic resin containing long fibers for reinforcement.

5. A bat for an upright piano according to claim 4, wherein said long fibers are carbon fibers.

6. A bat for an upright piano according to claim 4, wherein said thermoplastic resin is an ABS resin.

* * * * *